United States Patent [19]

Bittencourt

[11] Patent Number: 4,845,776

[45] Date of Patent: Jul. 4, 1989

[54] PIEZOELECTRIC TRANSDUCER AND TRANSFORMER CIRCUIT

[75] Inventor: Helio T. Bittencourt, Sao Paulo, Brazil

[73] Assignee: Electro Acustica S.A., Brazil

[21] Appl. No.: 48,745

[22] Filed: May 11, 1987

[51] Int. Cl.[4] ..... H04R 17/00; H04R 7/02

[52] U.S. Cl. ..... 381/190; 381/156; 381/202; 310/322; 310/324; 310/332

[58] Field of Search ..... 381/190, 201, 202, 205, 381/156; 310/318, 322, 324, 332, 368; 181/157, 161, 166

[56] References Cited

U.S. PATENT DOCUMENTS

| | | | |
|---|---|---|---|
| 2,102,668 | 12/1937 | Ballantine | 381/190 X |
| 2,168,809 | 8/1939 | Semple, Jr. | 310/322 X |
| 2,242,755 | 5/1941 | Pope | 381/190 |
| 2,242,756 | 5/1941 | Pope | 381/190 |
| 2,242,757 | 5/1941 | Romanow | 381/190 |
| 2,270,167 | 1/1942 | Meissner et al. | 381/190 |
| 2,308,930 | 1/1943 | Penn | 381/190 X |
| 2,414,489 | 1/1947 | Shomer | 310/322 X |
| 2,593,031 | 4/1952 | Howatt | 381/190 X |
| 3,712,962 | 1/1973 | Epley | 381/190 X |
| 4,283,605 | 8/1981 | Nakajima | 381/190 X |

OTHER PUBLICATIONS

Yoshimuro, H., et al; "Development of a Solid State Horn Type Loudspeaker"; *Nat'l Technical Report;* vol. 16, No. 3, Jun. 1970; pp. 390–396.

*Primary Examiner*—Eugene R. LaRoche
*Assistant Examiner*—Benny Lee
*Attorney, Agent, or Firm*—Steinberg & Raskin

[57] ABSTRACT

An electroacoustic piezoelectric transducer, particularly useful as a high frequency loudspeaker or tweeter, includes a concave diaphragm mounted in a housing along its periphery outwardly of a peripheral inflection region thereof. A substantially square piezoelectric bimorph element is affixed to a central region of the inner concave surface of the diaphragm by securing each of its four corners to the diaphragm. The bimorph element is directly coupled to a transformer in an electrical circuit including a low voltage AC source for applying an alternating voltage thereto. In operation when an appropriate alternating voltage is applied to the square bimorph element, in-phase vibrational displacements of the four corners thereof which are fixed to the diaphragm occur which cause the diaphragm to vibrate in its entirety about its peripheral inflection region to produce sound at an amplitude greater than the amplitude of vibration of the bimorph element. The transformer provides an increased excitation level so that the bimorph element provides good high frequency response. By virtue of the direct connection between the transformer and the piezoelectric bimorph element, the sensitivity of the bimorph element increases up to 15 db depending on the turn ratio of the transformer. The bandwidth can also be controlled in a range of between about 3 kHz to 30 kHz through suitable design of the primary inductance of the transformer.

3 Claims, 2 Drawing Sheets

PIEZOELECTRIC TRANSDUCER AND TRANSFORMER CIRCUIT

BACKGROUND OF THE INVENTION

This invention relates generally to electroacoustic piezoelectric transducers and, more particularly, to high frequency electroacoustic piezoelectric transducers of the type which convert electrical current to high frequency sound. Such transducers are especially useful in small loudspeakers for producing sounds of high pitch, known as tweeters.

Electroacoustic or electromechanical piezoelectric transducers are known which convert electric current to sound. Such known piezoelectric transducers, when used in small loudspeakers for producing high pitch sounds, i.e., tweeters, generally require amplification stages in order to amplify the electric current applied to the piezoelectric element or crystal so that the volume of the sound produced is sufficient to be heard. The provision of such amplification stages results in the transducer being relatively complex in construction and expensive in manufacture.

Known high frequency loudspeakers or tweeters function through a displacement of the diaphragm produced by a moving coil which receives voltage and current through a coupled inductance. Although it is known to replace the moving coil by a vibratory ceramic element, the use of a ceramic element has been limited due to the generally inferior response obtained by such devices.

SUMMARY OF THE INVENTION

One object of the present invention is to provide a new and improved electroacoustic piezoelectric transducer.

Another object of the present invention is to provide a new and improved electroacoustic piezoelectric transformer which is simple in construction and inexpensive in manufacture.

Still another object of the present invention is to provide a new and improved electroacoustic piezoelectric transducer which has particular application in high pitch loudspeakers known as tweeters and which produce sound of high volume without the need for additional amplification stages.

A further object of the present invention is to provide a new and improved electroacoustic piezoelectric transducer which converts electrical signals to sound and vice versa in an efficient, effective and reliable manner.

Briefly in accordance with the present invention these and other objects are attained by providing an electroacoustic piezoelectric transducer including a concave diaphragm having an inner concave surface, an outer convex surface and a peripheral inflection region. The diaphragm is mounted to a housing along its periphery outwardly of the peripheral inflection region. A substantially square piezoelectric bimorph element is affixed in a symmetrical manner to a central region of the inner diaphragm surface by securing each of its four corners to the diaphragm surface. The bimorph element is electrically coupled to circuit means in a manner such that when an alternating voltage is applied, in-phase vibrational displacements of the corner regions of the bimorph element which are secured to the diaphragm occur. In particular, in accordance with the invention, the bimorph element is directly coupled to the secondary winding of a transformer, the primary winding of which is coupled to a low voltage AC source. The in-phase vibrational displacements of the corners of the bimorph element cause the diaphragm to vibrate in its entirety about its peripheral inflection region which in turn produces high pitch sound which is proportional to the electrical current and at an amplitude which is greater than the amplitude of vibrations of the bimorph element. The transformer provides an increased excitation level so that the bimorph element provides good high frequency response. By virtue of the direct connection between the transformer and the piezoelectric bimorph element, the sensitivity of the bimorph element increases up to 15 db depending on the turn ratio of the transformer. The bandwidth can also be controlled in a range of between about 3 kHz to 30 kHz through suitable design of the primary inductance of the transformer.

When sound waves impinge upon the diaphragm, an electric current proportional to the sound is produced at the terminals.

DETAILED DESCRIPTION OF THE DRAWINGS

A more complete appreciation of the present invention and many of the attendant advantages thereof will be readily understood by reference to the following detailed description when considered in connection with drawings in which.

DESCRIPTION OF THE PREFERRED EMBODIMENTS

Figure 1:
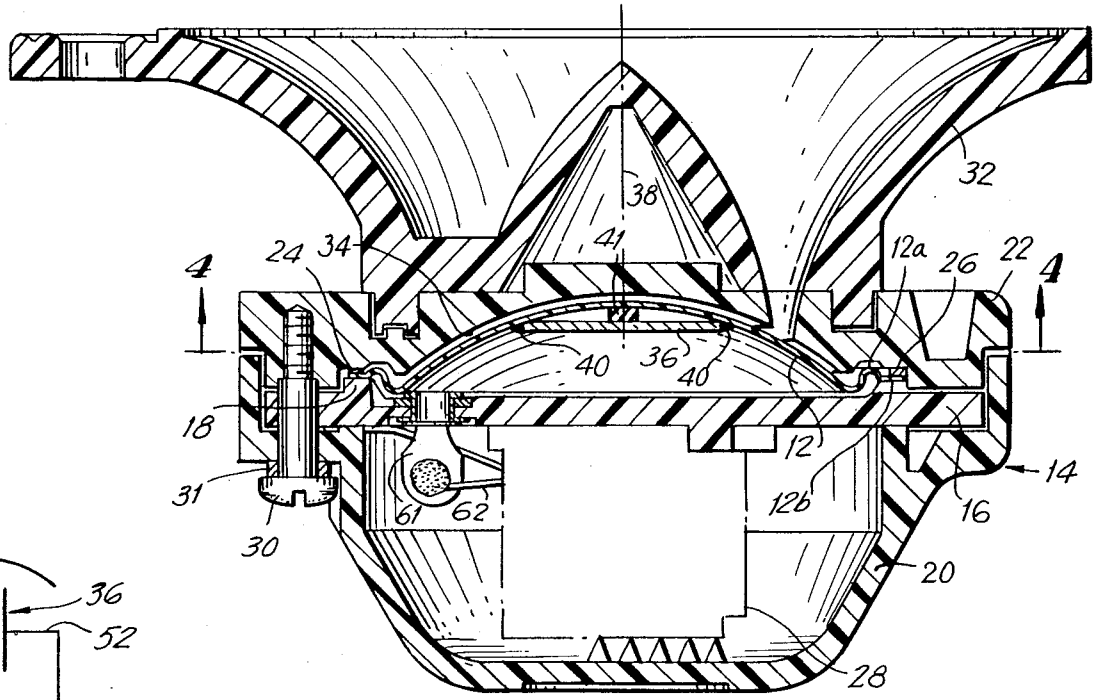
FIG. 1 is a side elevation view in cross-section of an embodiment of an electroacoustic piezoelectric transducer in accordance with the present invention.

Referring now to the drawings wherein like reference characters designate identical or corresponding parts throughout the several views, and more particularly to FIG. 1, an electroacoustic piezoelectric transducer, generally designated 10, comprises a concave diaphragm 12 having inner concave and outer convex surfaces and a peripheral inflection region 12*a*. The diaphragm 12 is mounted in a housing 14 along its periphery 12*b* outwardly of the inflection region 12*a*.

More particularly, housing 14 includes a support member 16 having an annular platform 18, a rear cover member 20 and a front piece 22 having a central region formed with sound transmitting openings (not shown) and an annular shoulder 24 which, upon assembly of the housing, is situated in opposed relationship to platform 18. The diaphragm is mounted in housing 14 by placing the same onto support member 16 with its periphery 12*b* resting on platform 18 and so that terminals 50*a* and 52*a* (FIG. 3) electrically engage corresponding terminal strips on platform 18 (not shown) coupled to internal terminals 61. A washer 26 may be positioned over the periphery 12*b* of the diaphragm and the front piece 22 situated with the shoulder 24 bearing against the washer 26. After mounting the circuitry housing 28 on the other side of support 16, the cover member 20 is situated thereover and the assembly is secured by means of threaded fasteners 30 which are preferably conductive and which also serve to mount external terminals 31. A horn 32 is snap fit onto the front piece 22 as shown in FIG. 1. The diaphragm 12 is thus mounted within the housing along its periphery 12*b* outwardly of the peripheral inflection region 12*a*. The inner surface 34 of front piece 22 has a concave configuration and provides sufficient space for the diaphragm 12 to vibrate in its entirety about its peripheral inflection region 12*a*.

A substantially square piezoelectric bimorph element 36 is affixed to a central region of the inner concave surface of the diaphragm 12 substantially symmetrically with respect to the central axis 38 of the diaphragm. Specifically, the bimorph element 36 is affixed to diaphragm 12 by rigidly securing each of its four corners 36*a*, 36*b*, 36*c* and 36*d* (FIG. 3) to the inner diaphragm surface such as by applying a drop 40 of enamel in liquid form to each corner and allowing the enamel to cure, care being taken to assure that only the regions of the corners of the bimorph element are so secured to the diaphragm and that the regions of securement are substantially symmetrically located with respect to the central axis 38 of the diaphragm. Other suitable means for securing the corners of the bimorph element to the diaphragm may be utilized.

Prior to securing the bimorph element 36 to the diaphragm 12 as described above, a piece of resilient material 41 formed of any suitable elastomeric material is situated between the bimorph element and the diaphragm as seen in FIG. 1. The resilient piece 41 functions to damp any spurious vibrations of the diaphragm during operation.

Figure 4:
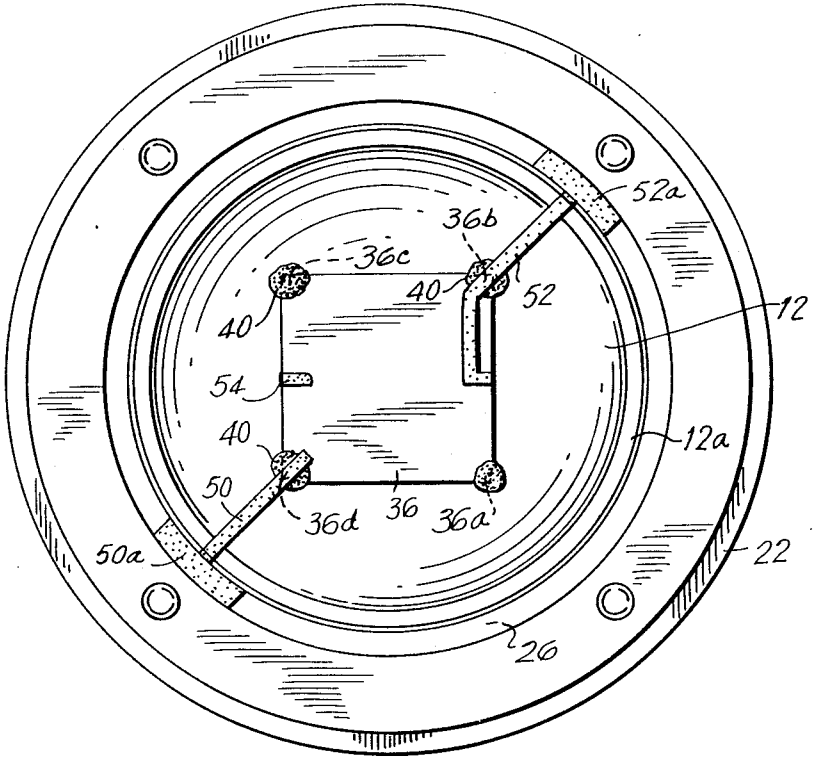
FIG. 4 is a cross-sectional view of a piezoelectric bimorph element comprising a component of the present invention and schematically illustrating the connection of the circuit means to the terminals thereof.
Figure 5:
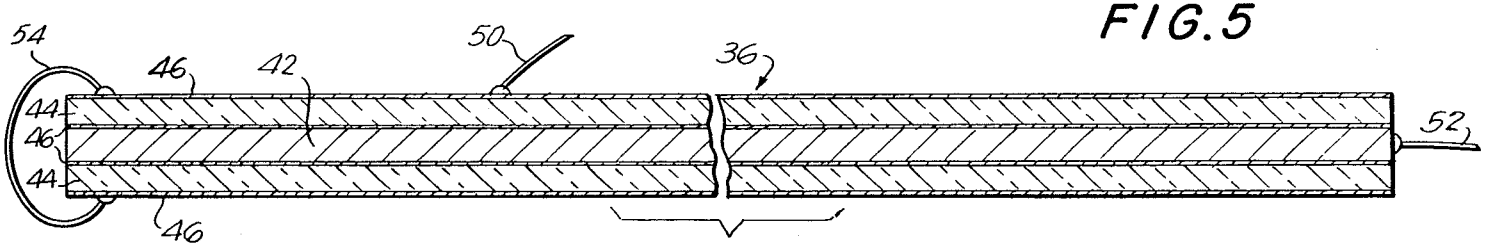

Referring to FIG. 4, the bimorph element 36 has a substantially planar sandwich construction formed of a central layer 42 of conductive material, such as brass, interposed between outer layers 44 of ceramic material. Thin coatings 46 of nickel may be applied between the central and outer layers and to the outer surfaces of the outer layers.

Figure 3:
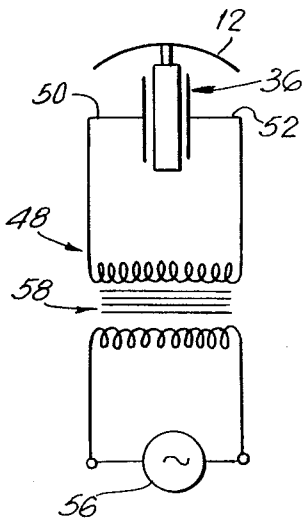
FIG. 3 is a view taken along line 3—3 of FIG. 1 illustrating the affixation of the piezoelectric bimorph element to the diaphragm in accordance with the present invention.
Figure 2:
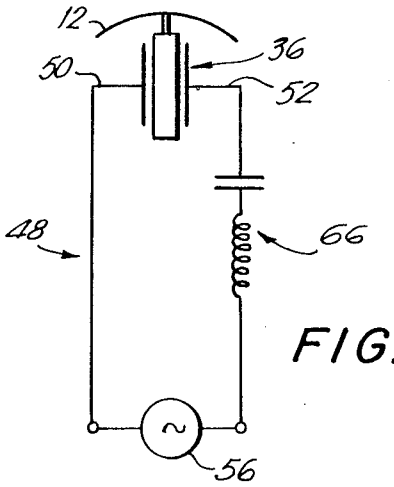
FIG. 2 is a schematic diagram of an electroacoustic piezoelectric transducer driven by circuit means including a transformer device in accordance with the present invention.

In accordance with the invention, bimorph element 36 is electrically coupled to circuit means, generally designated 48 in FIG. 2, designed to increase the sensitivity of the piezoelectric bimorph element while providing the ability to control the bandwidth. The circuit means (except for the voltage, source) is housed within circuitry housing 28. As seen in FIGS. 3 and 4, one circuit conductor terminal 50, preferably in the form of a strip of conductive ink, is electrically coupled to the top layer of the bimorph element while the other circuit conductor terminal 52 is coupled to the central layer 42 of the bimorph element. As seen in FIG. 4, a layer of insulation is provided between terminal 52 and the outer nickel layer 46 to prevent electrical contact therebetween. The outer layers of the bimorph element are electrically coupled by a conductor 54. In accordance with the invention, the terminals 50 and 52 are connected to a low voltage source 56 of alternating current through a low powered transformer 58 (FIG. 2). In particular, the terminals 50 and 52 are directly connected to the secondary winding of transformer 58 through terminals 50*a* and 52*a* (FIG. 3), and the terminal strips (not shown) on platform 18. The primary winding of transformer 58 is connected to the voltage source by conductors 62, internal terminals 61 and external terminals 31 (FIG. 1).

The transformer 58 functions to increase the excitation level of the bimorph element 36 so that the latter functions appropriately in the high frequency band. The bandwidth within which the bimorph element operates can be controlled from about 3 kHz to about 30 kHz by virtue of the direct connection by properly designing the primary inductance of the transformer. Contrary to impedance transformers, or impedance collectors, which function to adapt the impedance of the voltage source, generally a radio amplifier, to the impedance of the loudspeaker, the voltage applied to the bimorph element 36 is increased relative to that applied to the transformer. This in turn increases the sensitivity of the piezoelectric bimorph element 36 up to 15 db depending upon the turn ratio of the transformer.

In order to operate the transducer of the invention as an electrical-to-acoustic or electrical-to-mechanical converter, an alternating electric voltage having a frequency between 3 Hz and 50 kHz is applied (such as from a radio amplifier) to the external terminals 31 of the transducer and flows through the conductors described above to the conductor terminals 50 and 52. Application of an alternating voltage in this manner causes in-phase vibrational displacements of the corners 36*a*–36*d* of the bimorph element 36 which are secured to the diaphragm. In other words, the corners 36*a*–36*d* of the bimorph element 36 simultaneously move in the same direction with the same amplitude in a vibratory manner. The in-phase vibrational displacements of the corners of the bimorph element causes the diaphragm to vibrate in its entirety in an even manner about the inflection region 12*a*. Furthermore, these vibrations are amplified due to the shape of the diaphragm and the manner in which the bimorph element 36 is bonded thereto. The amplitude of vibration of the diaphragm is thus greater than that of the bimorph element 36 so that the sound produced by the diaphragm is proportional to the electrical signals applied and is effectively produced at sufficient volume to eliminate the need for any additional amplification stages.

Conversely, in order to operate the transducer as a converter of sound or acoustic energy to electrical energy, ambient sound from the environment which impinges upon the diaphragm will produce vibrations thereof and consequent in-phase displacements of the corners of the bimorph element bonded to the diaphragm. This produces proportional electric currents in the conductor terminal 50 and 52 which are transmitted via the conductors to the external terminals.

The bonding of the bimorph element 36 directly to the concave surface of the diaphragm 12 provides a great and intense volume of sound without amplification stages when electric current is applied thereto. The bimorph element may be of any suitable size. The transducer of the invention thus operates at least as well as known similar transducers which require amplification stages, although the transducer of the invention is devoid of amplification stages and is of considerably more simple structure and less expensive in manufacture than such know transducers.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. An electroacoustic transducer, comprising:

a housing;

a concave diaphragm having a peripheral region and an inner concave surface defining an interior space within said diaphragm, said diaphragm being mounted in said housing about said peripheral region thereof;

a polygonal bimorph element having a substantially symmetrical shape defining a plurality of corners, said corners and only said corners of said bimorph element being rigidly secured directly to said inner concave surface of said diaphragm substantially symmetrically with respect to a central axis of said diaphragm to thereby directly affix said bimorph element to a central region of said inner diaphragm surface within said interior space thereof, said bimorph element being of the type wherein in-phase vibrational displacements of said corners occur upon application of an alternating voltage thereto; and electrical circuit means coupled to said bimorph element for conducting alternating voltage to or from said bimorph element, said circuit means including a band pass transformer having a primary coil adapted to be connected to a source of low voltage alternating current and a secondary coil directly connected to said bimorph element, whereby the sensitivity of the bimorph element is increased up to about 15 db and the bandwidth within which the bimorph element operates can be controlled from about 3 kHz to about 30 kHz.

2. The combination of claim 1 wherein said bimorph element has a substantially square configuration with four corners and wherein said four corners of said bimorph element are directly secured to the inner surface of said diaphragm at locations substantially symmetrical with respect to said central axis of said diaphragm.

3. The combination of claim 1 wherein a piece of resilient material is situated between the center of said bimorph element and said inner surface of said diaphragm along the axis thereof to damp any spurious vibrations.

* * * * *